US010295920B2

(12) United States Patent
Nishikawa et al.

(10) Patent No.: US 10,295,920 B2
(45) Date of Patent: May 21, 2019

(54) TONER

(71) Applicant: CANON KABUSHIKI KAISHA, Tokyo (JP)

(72) Inventors: Koji Nishikawa, Susono (JP); Yojiro Hotta, Mishima (JP); Kazuo Terauchi, Numazu (JP); Takaaki Furui, Tokyo (JP); Ryo Nagata, Mishima (JP); Keisuke Tanaka, Yokohama (JP); Kazuyuki Sato, Yokohama (JP); Yu Yoshida, Mishima (JP); Yusuke Kosaki, Susono (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/901,220

(22) Filed: Feb. 21, 2018

(65) Prior Publication Data

US 2018/0246432 A1 Aug. 30, 2018

(30) Foreign Application Priority Data

Feb. 28, 2017 (JP) ..... 2017-035805
Jan. 17, 2018 (JP) ..... 2018-005701

(51) Int. Cl.

*G03G 9/097* (2006.01)
*G03G 9/093* (2006.01)
*G03G 9/08* (2006.01)
*G03G 9/087* (2006.01)

(52) U.S. Cl.

CPC ..... *G03G 9/0827* (2013.01); *G03G 9/0819* (2013.01); *G03G 9/08797* (2013.01); *G03G 9/09307* (2013.01); *G03G 9/09321* (2013.01); *G03G 9/09328* (2013.01); *G03G 9/09342* (2013.01); *G03G 9/09708* (2013.01)

(58) Field of Classification Search

CPC ..... G03G 9/09716; G03G 9/09328; G03G 9/09321; G03G 9/09342; G03G 9/0827; G03G 9/09708
USPC ..... 430/108.6
See application file for complete search history.

(56) References Cited

U.S. PATENT DOCUMENTS 4,657,838 A 4/1987 Fukumoto et al.
4,673,631 A 6/1987 Fukumoto et al.
4,710,443 A 12/1987 Tanaka et al.
4,737,432 A 4/1988 Tanaka et al.
4,839,255 A 6/1989 Hyosu et al.
4,886,725 A 12/1989 Tanaka et al.
5,071,727 A 12/1991 Ikeda et al.
5,288,579 A 2/1994 Tanaka et al.
5,306,588 A 4/1994 Tanaka et al.
5,354,637 A 10/1994 Shimamura et al.
5,356,749 A 10/1994 Hagiwara et al.
5,406,357 A 4/1995 Nakahara et al.
5,415,967 A 5/1995 Sakashita et al.
5,436,701 A 7/1995 Shimojo et al.
5,447,813 A 9/1995 Hagiwara et al.
5,508,139 A 4/1996 Tanaka et al.
5,547,796 A 8/1996 Kohtaki et al.
5,716,746 A 2/1998 Mikuriya et al.
5,968,701 A 10/1999 Onuma et al.
6,020,102 A 2/2000 Fujimoto et al.
6,120,961 A 9/2000 Tanikawa et al.
6,156,471 A 12/2000 Kobori et al.
6,203,959 B1 3/2001 Tanikawa et al.
6,235,441 B1 5/2001 Tanikawa et al.
6,528,222 B2 3/2003 Kohtaki et al.
6,541,174 B1 4/2003 Tanikawa et al.
6,586,147 B2 7/2003 Iida et al.
6,638,674 B2 * 10/2003 Komoto ..... G03G 9/0821 430/106.1
6,653,036 B1 11/2003 Tanikawa et al.
6,670,087 B2 12/2003 Fujikawa et al.
6,751,424 B2 6/2004 Komatsu et al.
6,808,852 B2 10/2004 Hotta et al.
6,929,894 B2 8/2005 Sugahara et al.
7,115,349 B2 10/2006 Iida et al.

(Continued)

FOREIGN PATENT DOCUMENTS

EP 1 515 196 3/2005
EP 2 818 932 12/2014
EP 2 853 945 4/2015
JP 2003-277054 10/2003

(Continued)

OTHER PUBLICATIONS

U.S. Appl. No. 15/814,818, filed Nov. 16, 2017, Masao Suzuki.
U.S. Appl. No. 15/840,404, filed Dec. 13, 2017, Kosuke Fukudome.
U.S. Appl. No. 15/843,137, filed Dec. 15, 2017, Atsuhiko Ohmori.
U.S. Appl. No. 15/889,585, filed Feb. 6, 2018, Shinnosuke Koji.
U.S. Appl. No. 15/903,241, filed Feb. 23, 2018, Keisuke Tanaka.

*Primary Examiner* — Janis L Dote
(74) *Attorney, Agent, or Firm* — Venable LLP

(57) ABSTRACT

Provided is toner that contains a toner particle, and an external additive containing a strontium titanate particle, wherein the toner has an average circularity of at least 0.935 and not more than 0.995, the strontium titanate particle has a number-average primary particle diameter of at least 10 nm and not more than 60 nm, the strontium titanate particle has a peak in the range of 39.700°±0.150° and a peak in the range of 46.200°±0.150° in a CuKα x-ray diffraction spectrum obtained in the 2θ range of at least 10° and not more than 90° where θ is the Bragg angle, and the ratio of the area Sb of the peak at 46.200°±0.150° to the area Sa of the peak at 39.700°±0.150° is at least 1.80 and not more than 2.30.

11 Claims, 1 Drawing Sheet

(56) References Cited

U.S. PATENT DOCUMENTS

| | | | | |
|---|---|---|---|---|
| 7,135,263 | B2 * | 11/2006 | Kawakami | G03G 9/09708 430/108.4 |
| 7,138,213 | B2 | 11/2006 | Itakura et al. | |
| 7,144,668 | B2 | 12/2006 | Baba et al. | |
| 7,147,980 | B2 | 12/2006 | Itakura et al. | |
| 7,147,981 | B2 | 12/2006 | Fujikawa et al. | |
| 7,244,539 | B2 | 7/2007 | Baba et al. | |
| 7,273,686 | B2 | 9/2007 | Onuma et al. | |
| 7,288,354 | B2 | 10/2007 | Moribe et al. | |
| 7,351,509 | B2 | 4/2008 | Moribe et al. | |
| 7,422,832 | B2 | 9/2008 | Ogawa et al. | |
| 7,455,947 | B2 | 11/2008 | Ida et al. | |
| 7,537,877 | B2 | 5/2009 | Yoshiba et al. | |
| 7,582,401 | B2 | 9/2009 | Ogawa et al. | |
| 7,629,100 | B2 | 12/2009 | Okamoto et al. | |
| 7,700,254 | B2 | 4/2010 | Moribe et al. | |
| 7,740,998 | B2 | 6/2010 | Yamazaki et al. | |
| 7,745,089 | B2 | 6/2010 | Okubo et al. | |
| 7,767,370 | B2 | 8/2010 | Ishigami et al. | |
| 7,816,063 | B2 | 10/2010 | Hashimoto et al. | |
| 7,855,042 | B2 | 12/2010 | Kobori et al. | |
| 7,897,316 | B2 | 3/2011 | Yamazaki et al. | |
| 7,906,262 | B2 | 3/2011 | Ishigami et al. | |
| 8,057,977 | B2 | 11/2011 | Moribe et al. | |
| 8,142,972 | B2 | 3/2012 | Hotta et al. | |
| 8,293,447 | B2 | 10/2012 | Yamazaki et al. | |
| 8,501,377 | B2 | 8/2013 | Takahashi et al. | |
| 8,512,925 | B2 | 8/2013 | Moribe et al. | |
| 8,697,327 | B2 * | 4/2014 | Shibata | G03G 9/09328 430/110.1 |
| 8,927,188 | B2 | 1/2015 | Naka et al. | |
| 9,040,216 | B2 | 5/2015 | Fukudome et al. | |
| 9,046,800 | B2 | 6/2015 | Hotta et al. | |
| 9,097,998 | B2 | 8/2015 | Yamazaki et al. | |
| 9,116,448 | B2 | 8/2015 | Terauchi et al. | |
| 9,128,400 | B2 | 9/2015 | Takahashi et al. | |
| 9,134,637 | B2 | 9/2015 | Hotta et al. | |
| 9,141,012 | B2 | 9/2015 | Moribe et al. | |
| 9,158,216 | B2 | 10/2015 | Shimano et al. | |
| 9,201,323 | B2 | 12/2015 | Nishikawa et al. | |
| 9,213,251 | B2 | 12/2015 | Ohmori et al. | |
| 9,235,151 | B2 | 1/2016 | Tanaka et al. | |
| 9,239,528 | B2 | 1/2016 | Hasegawa et al. | |
| 9,250,548 | B2 | 2/2016 | Nomura et al. | |
| 9,261,804 | B2 | 2/2016 | Yamazaki et al. | |
| 9,309,349 | B2 | 4/2016 | Watanabe et al. | |
| 9,341,970 | B2 | 5/2016 | Yoshiba et al. | |
| 9,377,705 | B2 | 6/2016 | Shimano et al. | |
| 9,383,668 | B2 | 7/2016 | Noji et al. | |
| 9,429,860 | B2 | 8/2016 | Kinumatsu et al. | |
| 9,470,993 | B2 | 10/2016 | Nishikawa et al. | |
| 9,575,424 | B2 | 2/2017 | Nakagawa et al. | |
| 9,575,425 | B2 | 2/2017 | Naka et al. | |
| 9,588,450 | B2 | 3/2017 | Tsuda et al. | |
| 9,599,919 | B2 | 3/2017 | Isono et al. | |
| 9,606,462 | B2 | 3/2017 | Nomura et al. | |
| 9,658,546 | B2 | 5/2017 | Tanaka et al. | |
| 9,658,554 | B2 | 5/2017 | Kinumatsu et al. | |
| 9,715,188 | B2 | 7/2017 | Terauchi et al. | |
| 9,772,570 | B2 | 9/2017 | Tsuda et al. | |
| 9,778,583 | B2 | 10/2017 | Terauchi et al. | |
| 9,785,071 | B2 | 10/2017 | Shimano et al. | |
| 9,798,256 | B2 | 10/2017 | Kosaki et al. | |
| 9,798,262 | B2 | 10/2017 | Toyoizumi et al. | |
| 9,811,016 | B2 | 11/2017 | Aoki et al. | |
| 9,823,595 | B2 | 11/2017 | Toyoizumi et al. | |
| 9,829,814 | B2 | 11/2017 | Yoshida et al. | |
| 9,829,816 | B2 | 11/2017 | Tanaka et al. | |
| 9,829,818 | B2 | 11/2017 | Yoshiba et al. | |
| 9,835,964 | B2 | 12/2017 | Yoshida et al. | |
| 9,857,707 | B2 | 1/2018 | Tsuda et al. | |
| 9,857,711 | B2 | 1/2018 | Yoshida et al. | |
| 9,857,713 | B2 | 1/2018 | Kosaki et al. | |
| 9,869,943 | B2 | 1/2018 | Aoki et al. | |
| 9,897,932 | B2 | 2/2018 | Hotta et al. | |
| 9,904,195 | B2 | 2/2018 | Matsui et al. | |
| 2005/0058926 | A1 | 3/2005 | Kawakami et al. | |
| 2005/0209364 | A1 | 9/2005 | Yamagishi et al. | |
| 2013/0252167 | A1 | 9/2013 | Moribe et al. | |
| 2013/0309603 | A1 | 11/2013 | Takahashi et al. | |
| 2014/0004460 | A1 | 1/2014 | Yoshiba et al. | |
| 2015/0125790 | A1 | 5/2015 | Hotta et al. | |
| 2015/0220013 | A1 | 8/2015 | Nishikawa et al. | |
| 2015/0227067 | A1 | 8/2015 | Hasegawa et al. | |
| 2015/0227068 | A1 | 8/2015 | Sano et al. | |
| 2016/0139522 | A1 | 5/2016 | Yoshiba et al. | |
| 2016/0161874 | A1 | 6/2016 | Yamazaki et al. | |
| 2016/0202624 | A1 | 7/2016 | Nishikawa et al. | |
| 2017/0199475 | A1 | 7/2017 | Fukudome et al. | |
| 2017/0269491 | A1 | 9/2017 | Terui et al. | |
| 2017/0269494 | A1 | 9/2017 | Yoshida et al. | |
| 2017/0269495 | A1 | 9/2017 | Terui et al. | |
| 2017/0269496 | A1 | 9/2017 | Kubo et al. | |
| 2018/0004106 | A1 | 1/2018 | Matsui et al. | |
| 2018/0004108 | A1 | 1/2018 | Tsuda et al. | |
| 2018/0004109 | A1 | 1/2018 | Matsui et al. | |
| 2018/0074425 | A1 | 3/2018 | Mizuguchi et al. | |

FOREIGN PATENT DOCUMENTS

| | | |
|---|---|---|
| JP | 2007-033485 | 2/2007 |
| JP | 2007-292982 | 11/2007 |
| JP | 2010-039264 | 2/2010 |
| JP | 4944980 | 6/2012 |
| JP | 2015-137208 | 7/2015 |
| JP | 2016-110052 | 6/2016 |

* cited by examiner

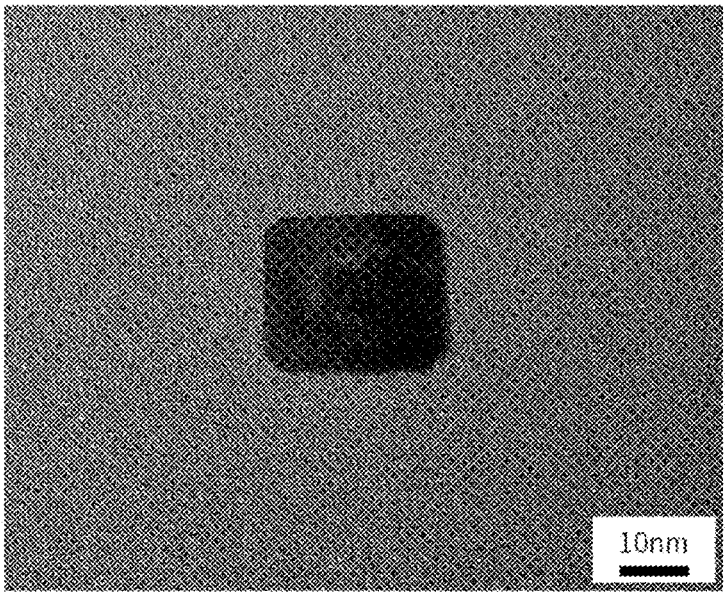
10nm

TONER

BACKGROUND OF THE INVENTION

Field of the Invention

The present invention relates to a toner used in image-forming methods such as electrophotography.

Description of the Related Art

Higher speeds, a longer life, greater energy savings, and smaller sizes are being required of electrophotographic image-forming devices, and in order to respond to these demands, additional improvements in various properties are being required of also toner. In particular, additional improvements in quality stability are being required of toner from the viewpoint of achieving a longer life.

With regard, in particular, to achieving a longer life, it is crucial that the quality not undergo large changes even during long-term repetitive use, and a variety of toners and external additives have been proposed here.

For example, a smooth, high-circularity toner is frequently used in order to maintain an excellent developing performance even during long-term repetitive use. The basis for this is thought to be as follows: a high-circularity toner readily undergoes rolling and as a result the toner surface can then be uniformly charged. On the other hand, high-circularity toners also readily take on a charged-up condition, i.e., they end up becoming excessively charged. Due to this, in a method that has been one means for controlling the charging performance of high-circularity toners, the toner charging performance has been stabilized by the use of an external additive as a resistance regulator.

Particles of strontium titanate, which is a substance having an intermediate resistance, have been used as a resistance regulator that provides an excellent regulation of the charging of high-circularity toners.

The strontium titanate particles used as an external additive have a hexahedral shape and often have smooth sides. The area of contact with the toner particle increases when the strontium titanate particle has smooth sides, and this makes it easy for charge to move between the toner particle and the strontium titanate particle. As a consequence, even when the toner particle has assumed a charged-up state due to triboelectric charging, the charge can be diffused and the toner particle can be uniformly charged. It has been possible as a result for an excellent developing performance to be exhibited from the initial phase of duration.

However, when subjected to repeated rubbing within the developing unit during long-term repetitive use, conventional strontium titanate particles have sometimes migrated from the toner particle, resulting in fluctuations in the charging performance of the toner in the final phase of long-term repetitive use and the appearance of a trend wherein the charging performance readily declines. This migration denotes a phenomenon in which the external additive transfers from a toner particle to another toner particle or to another member. Thus, it denotes a phenomenon in which the external additive does not stay on the toner particle.

Japanese Patent Application Laid-open No. 2015-137208 proposes that the environmental characteristics and charging characteristics of toner can be improved through the external addition to the toner particle of a strontium titanate particle having a controlled $SrO/TiO_2$ (molar ratio).

Japanese Patent No. 4944980 proposes that the inhibition of image smearing in high-temperature, high-humidity environments can be enhanced by the external addition to the toner particle of a strontium titanate particle that has a controlled crystalline structure and a controlled shape.

Japanese Patent Application Laid-open No. 2003-277054 proposes that the flowability and humidity resistance of toner can be improved by the external addition to the toner particle of a strontium titanate particle having a controlled particle size distribution.

SUMMARY OF THE INVENTION

With the art described in Japanese Patent Application Laid-open No. 2015-137208, Japanese Patent No. 4944980, and Japanese Patent Application Laid-open No. 2003-277054, certain effects are observed with regard to the environmental characteristics of toner, the charging characteristics of toner, and the inhibition of image smearing. However, for the combination of this art with high-circularity toner, in each case there has been room for additional investigations with regard to long-term repetitive use.

The present invention provides a toner that solves this existing problem.

That is, the present invention provides a toner that has an excellent developing performance and that can suppress the appearance of fogging and member contamination, even for the case of the long-term repetitive use of a high-circularity toner.

The present invention is a toner containing a toner particle, and an external additive containing a strontium titanate particle, wherein the toner has an average circularity of at least 0.935 and not more than 0.995, the strontium titanate particle has a number-average primary particle diameter of at least 10 nm and not more than 60 nm, the strontium titanate particle has a peak in the range of 39.700°±0.150° and a peak in the range of 46.200°±0.150° in a CuKα x-ray diffraction spectrum obtained in the 2θ range of at least 10° and not more than 90° where θ is the Bragg angle, and where Sa is an area of the peak at 39.700°±0.150° and Sb is an area of the peak at 46.200°±0.150°, Sb/Sa is at least 1.80 and not more than 2.30.

The present invention can thus provide a toner that has an excellent developing performance and that can suppress the appearance of fogging and member contamination, even for the case of the long-term repetitive use of a high-circularity toner.

Further features of the present invention will become apparent from the following description of exemplary embodiments with reference to the attached drawing.

BRIEF DESCRIPTION OF THE DRAWING

The FIGURE is a transmission electron micrograph of a strontium titanate particle 1 from the Production Example.

DESCRIPTION OF THE EMBODIMENTS

For the present invention, phrases such as "at least XX and not more than YY" and "XX to YY" that give numerical value ranges indicate, unless specifically indicated otherwise, numerical value ranges that include the lower limit and upper limit that are the end points.

As previously described, the use of strontium titanate particles is one means for controlling the charging performance of a high-circularity toner.

Due to the increased area of contact between the toner particle and strontium titanate particle provided by the external addition of hexahedral strontium titanate particles, the charge can be diffused and uniform charging can be achieved even when the toner particle assumes a charged-up state under triboelectric charging. As a result, an excellent developing performance and fogging suppression has been achieved from the initial phase of repetitive use.

However, with conventional strontium titanate particles, during long-term repetitive use the strontium titanate particles can migrate from the toner particle under the effect of the rubbing in the developing unit, which has resulted in fluctuations in the charging performance of the toner in the final phase of long-term repetitive use and the appearance of a deteriorating trend for the charging performance and fogging suppression.

The present inventors therefore sought to reduce the particle diameter of the strontium titanate particle in order to restrain the migration of the strontium titanate particles from the toner particle.

It was thought that, when the diameter is reduced, migration would be restrained even during exposure to repetitive rubbing in the developing unit. It was further thought that, when the diameter is reduced, rolling on the toner particle surface would be facilitated and as a consequence this would also be effective for uniform charging of the toner.

Reducing the particle diameter of the strontium titanate particle did in fact restrain strontium titanate particle migration even during repetitive rubbing in the developing unit during long-term repetitive use.

However, it was found that scratching of the toner particle surface is facilitated when reduced-particle diameter strontium titanate particles are applied to high-circularity smooth toners. Cracking of the toner particle was also found to occur depending on the circumstances. The occurrence of toner particle cracking has an effect on the toner charge distribution.

That is, it was found that when a small-particle diameter strontium titanate particle was applied to a high-circularity smooth toner, cracking of the toner particle caused fluctuations in the charge distribution and the developing performance of the toner was reduced; the generation of fogging was also found to be increased. In addition, the generation of contamination of members caused by the cracked toner particle was found to be facilitated.

As a result of extensive investigations, the present inventors discovered that an excellent developing performance could be obtained and the generation of fogging and member contamination could be suppressed—even for long-term repetitive use—by the use as an external additive of a small-particle diameter strontium titanate particle having a special profile in its x-ray diffraction spectrum. The present invention was achieved based on this discovery.

That is, the toner of the present invention is a toner that contains a toner particle, and an external additive containing a strontium titanate particle, wherein the toner has an average circularity of at least 0.935 and not more than 0.995, the strontium titanate particle has a number-average primary particle diameter of at least 10 nm and not more than 60 nm, the strontium titanate particle has a peak in the range of 39.700°±0.150° and a peak in the range of 46.200°±0.150° in a CuKα x-ray diffraction spectrum obtained in the 2θ range of at least 10° and not more than 90° where θ is the Bragg angle, and where Sa is an area of the peak at 39.700°±0.150° and Sb is an area of the peak at 46.200°±0.150°, Sb/Sa is at least 1.80 and not more than 2.30.

The strontium titanate particle has a peak in the range of 39.700°±0.150° and a peak in the range of 46.200°±0.150° in a CuKα x-ray diffraction spectrum obtained in the 2θ range of at least 10° and not more than 90° where θ is the Bragg angle.

Strontium titanate having peaks at these positions adopts the perovskite structure in the cubic crystal system, and the peaks in the range of 39.700°±0.150° and 46.200°±0.150° are diffraction peaks originating with, respectively, lattice planes having Miller indices of (111) and (200).

Particles belonging to the cubic crystal system generally readily adopt a hexahedral shape for the external shape of the particle, and with strontium titanate particles also, the particles grow during the production process while maintaining the (100) plane and (200) plane, which correspond to facet directions of the hexahedral shape.

However, as a result of our research, we discovered that excellent characteristics are exhibited with the use of a strontium titanate particle that has the (200) plane, corresponding to a facet direction of the hexahedral shape and the (111) plane, which corresponds to a vertex direction.

Moreover, as a result of detailed investigations, it was found that substantial effects are realized when Sb/Sa is at least 1.80 and not more than 2.30 where Sa is an area of the peak at 39.700°±0.150° and Sb is an area of the peak at 46.200°±0.150°. This Sb/Sa is preferably at least 1.80 and not more than 2.25.

The number-average primary particle diameter of the strontium titanate particle is at least 10 nm and not more than 60 nm. This number-average primary particle diameter is preferably at least 10 nm and not more than 50 nm.

When Sb/Sa and the number-average primary particle diameter are in the indicated ranges, strontium titanate particle migration from the toner particle and toner particle cracking can be suppressed even during the long-term repetitive use of a high-circularity toner. As a result, the toner exhibits an excellent developing performance and fogging and the occurrence of member contamination are suppressed.

The number-average primary particle diameter and the Sb/Sa of the strontium titanate particle can be controlled through adjustment of the molar ratio for the starting materials for the strontium titanate particle and adjustment of the production conditions, e.g., the application of a dry mechanical treatment and so forth.

Sr/Ti (molar ratio) for the strontium titanate particle is preferably at least 0.70 and not more than 0.85 and is more preferably at least 0.75 and not more than 0.83.

By having Sr/Ti (molar ratio) be in the indicated range, the proportion of Ti is increased to near to negative charging in terms of charging, and as a result the assumption of a sharp charge distribution is facilitated and the uniformity of halftone images is improved.

Sr/Ti (molar ratio) can be controlled by adjusting the molar ratio for the starting materials for the strontium titanate particle and adjusting its production conditions.

The average circularity of the primary particle of the strontium titanate particle is preferably at least 0.700 and not more than 0.920 and is more preferably at least 0.790 and not more than 0.920.

By adopting an average circularity in the indicated range, break up of the strontium titanate particles on the toner particle is facilitated and raising the coverage ratio by the strontium titanate particles is facilitated.

As a result, toner charge rise is facilitated from the initial phase of repetitive use and the effects with regard to the developing performance and fogging suppression are readily obtained in the initial phase of repetitive use. The average circularity of the primary particle of the strontium titanate particle can be controlled by adjusting the production conditions.

In a wettability test of the strontium titanate particle relative to a methanol/water mixed solvent, a methanol concentration at 50% transmittance of light at a wavelength of 780 nm is preferably at least 60 volume % and not more than 95 volume % and is more preferably at least 65 volume % and not more than 95 volume %.

Maintenance of the developing performance after standing in a high-temperature, high-humidity environment is facilitated when the indicated range is adopted for the methanol concentration.

The wettability of the strontium titanate particle relative to a methanol/water mixed solvent can be controlled by adjusting the surface treatment conditions for the strontium titanate particle.

The coverage ratio of the toner surface by the strontium titanate particle, as measured with an x-ray photoelectron spectrometer (ESCA), is preferably at least 5.0 area % and not more than 20.0 area % and is more preferably at least 8.0 area % and not more than 20.0 area %.

When the indicated range is adopted for the coverage ratio, toner charge rise is facilitated from the initial phase of repetitive use and the effects with regard to the developing performance and fogging suppression are readily obtained in the initial phase of repetitive use. The coverage ratio can be controlled through adjustment of the shape of the strontium titanate particle and its amount of addition and production conditions and adjustment of the properties of the toner particle.

The toner has an average circularity of at least 0.935 and not more than 0.995. The average circularity of the toner is preferably at least 0.940 and not more than 0.990.

The developing performance can be improved and fogging can be suppressed when this range is adopted for the average circularity of the toner. The average circularity of the toner can be controlled through adjustment of the production conditions.

The glass transition temperature (Tg) of the toner is preferably at least 50° C. and not more than 70° C. and is more preferably at least 52° C. and not more than 68° C.

The dispersion of the strontium titanate particle on the toner particle surface is facilitated when the indicated range is adopted for the glass transition temperature (Tg). Thus, a disperse state closer to that of the primary particle can be formed and as a consequence the coverage ratio by the strontium titanate particle can be raised. As a result, with reference to long-term repetitive use, the developing performance can be further improved and higher levels of suppression of both fogging and member contamination can be realized.

This glass transition temperature (Tg) can be controlled through, for example, adjustment of the composition of the binder resin constituting the toner.

Perovskite-type strontium titanate particles are preferably produced using a normal-pressure thermal reaction procedure, in which the reaction is run at normal pressure, rather than a hydrothermal process using a pressurized vessel.

The mineral acid deflocculation product of the hydrolyzate of a titanium compound is used as the titanium oxide source, and a water-soluble acidic compound is used as the strontium source. The method can be exemplified by running a reaction while adding an aqueous alkali solution at at least 60° C. to a mixture of the titanium oxide source and strontium source and subsequently carrying out an acid treatment.

In addition, the shape of the strontium titanate particle can also be controlled by the application of a dry mechanical treatment, and the value of Sb/Sa can be controlled by this method.

The normal-pressure thermal reaction procedure is described in the following.

The mineral acid deflocculation product of the hydrolyzate of a titanium compound may be used as the titanium oxide source.

The use is preferred of the deflocculation product provided by the deflocculation, by adjustment of the pH with hydrochloric acid to at least 0.8 and not more than 1.5, of a metatitanic acid produced by the sulfate method and having an $SO_3$ content of not more than 1.0 mass % and preferably not more than 0.5 mass %. Doing this makes it possible to obtain strontium titanate fine particles having an excellent particle size distribution.

On the other hand, strontium nitrate, strontium chloride, and so forth can be used as the strontium source. An alkali hydroxide can be used as the aqueous alkali solution, and in particular, an aqueous sodium hydroxide solution is preferred.

The factors that influence the particle diameter of the obtained strontium titanate particle in this production method are, for example, the mixing proportions for the titanium oxide source and the strontium source, the concentration of the titanium oxide source in the initial phase of the reaction, the temperature and addition rate when the aqueous alkali solution is added, and so forth. These factors can be adjusted as appropriate in order to obtain strontium titanate particles having the target particle diameter and particle size distribution. In order to prevent the production of strontium carbonate during the reaction process, the admixture of carbon dioxide gas is preferably prevented, for example, by running the reaction under a nitrogen gas atmosphere.

The mixing proportion between the strontium source and the titanium oxide source at the time of the reaction, as Sr/Ti (molar ratio), is preferably at least 0.90 and not more than 1.40 and is more preferably at least 1.05 and not more than 1.20.

The titanium oxide source has a low water solubility in contrast to the high water solubility of the strontium source, and as a consequence, when Sr/Ti (molar ratio) is less than 0.90, the reaction product will not be strontium titanate alone and unreacted titanium oxide will tend to still be present.

The concentration of the titanium oxide source at the initial phase of the reaction, as $TiO_2$, is preferably at least 0.050 mol/L and not more than 1.300 mol/L and is more preferably at least 0.080 mol/L and not more than 1.200 mol/L.

A smaller number-average primary particle diameter for the strontium titanate particles can be obtained by using a higher concentration for the titanium oxide source at the initial phase of the reaction.

With regard to the temperature during the addition of the aqueous alkali solution, a product exhibiting a better crystallinity is obtained as the temperature is raised. However, because a pressure vessel, e.g., an autoclave, is required at 100° C. and above, the range of at least 60° C. and not more than 100° C. is advantageous from a practical standpoint.

With regard to the rate of addition of the aqueous alkali solution, strontium titanate particles with larger particle diameters are obtained at slower rates of addition, while strontium titanate particles with smaller particle diameters are obtained at higher rates of addition. The rate of addition of the aqueous alkali solution, considered with reference to the starting materials charged, is preferably at least 0.001 eq/h and not more than 1.2 eq/h and is more preferably at least 0.002 eq/h and not more than 1.1 eq/h. This can be adjusted as appropriate in conformity to the particle diameter to be obtained.

The acid treatment is described in the following. When the mixing proportion between the strontium source and titanium oxide source exceeds 1.40 for Sr/Ti (molar ratio), unreacted strontium source remaining after the completion of the reaction will react with the carbon dioxide gas in the air to produce impurities, such as strontium carbonate, and the particle size distribution is prone to broadening. Moreover, when impurities such as strontium carbonate remain present on the surface, due to the influence of the impurities, the execution of a uniform coating by the surface treatment agent is impaired when a surface treatment is performed in order to impart hydrophobicity. Thus, once the aqueous alkali solution has been added, an acid treatment is preferably carried out in order to eliminate the unreacted strontium source.

Preferably the pH is adjusted in the acid treatment to at least 2.5 and not more than 7.0 using hydrochloric acid, while adjustment to a pH of at least 4.5 and not more than 6.0 is more preferred.

Acids other than hydrochloric acid, e.g., nitric acid, acetic acid, and so forth, can be used for the acid in the acid treatment. However, strontium sulfate, which has a low water solubility, is readily produced when sulfuric acid is used.

Control of the shape will now be described. The execution of a dry mechanical treatment is also an example of how to obtain the aforementioned shape for the strontium titanate particle.

The following, for example, can be used: the Hybridizer (Nara Machinery Co., Ltd.), Nobilta (Hosokawa Micron Corporation), Mechanofusion (Hosokawa Micron Corporation), and High Flex Gral (Earthtechnica Co., Ltd.). Sb/Sa is readily controlled to at least 1.80 and not more than 2.30 by treating the strontium titanate particles with these devices.

Fines may be produced from the strontium titanate particles when the shape of the strontium titanate particles is controlled using a mechanical treatment. In order to remove these fines, an acid treatment is preferably carried out after the mechanical treatment. The pH is preferably adjusted to at least 0.1 and not more than 5.0 using hydrochloric acid in this acid treatment. Acids other than hydrochloric acid, e.g., nitric acid, acetic acid, and so forth, can be used as the acid in the acid treatment. The mechanical treatment for controlling the shape of the strontium titanate particle is preferably carried out prior to the execution of any surface treatment on the strontium titanate particle.

To improve the charge regulation and environmental stability, the strontium titanate particle may be subjected to a surface treatment with an inorganic oxide, e.g., $SiO_2$, $Al_2O_3$, and so forth, or a hydrophobic agent, e.g., a titanium coupling agent, silane coupling agent, silicone oil, fatty acid metal salt, and so forth.

A silane coupling agent bearing a functional group such as the amino group, fluorine, and so forth may be used for the silane coupling agent here.

The fatty acid metal salt can be exemplified by zinc stearate, sodium stearate, calcium stearate, zinc laurate, aluminum stearate, and magnesium stearate. The same effects are also obtained with, for example, stearic acid, which is a fatty acid.

The method for carrying out the surface treatment can be exemplified by wet methods in which treatment is carried out by dissolving or dispersing the hydrophobic agent in a solvent; adding the strontium titanate particles to this; and removing the solvent while stirring.

Dry methods may also be used in which the strontium titanate particles are directly mixed with the treatment agent and treatment is carried out while stirring.

The content of the strontium titanate particle, per 100 mass parts of the toner particle, is preferably at least 0.05 mass parts and not more than 5.0 mass parts and is more preferably at least 0.1 mass parts and not more than 5.0 mass parts.

The method for producing the toner particle should be a method that can be controlled so as to provide an average circularity for the toner of at least 0.935 and not more than 0.995, but is not otherwise particularly limited. Examples here are methods in which the toner particle is directly produced in an aqueous medium (also referred to below as polymerization methods), such as suspension polymerization methods, interfacial polymerization methods, and dispersion polymerization methods. Pulverization methods may also be used, and the toner particle produced by a pulverization method may be subjected to a heat-sphering treatment in order to adjust its average circularity into the aforementioned range.

Suspension polymerization methods are preferred among the preceding. Toner particles produced using a suspension polymerization method have a high transferability because the individual particles are uniformly approximately spherical and a comparatively uniform distribution of the charge quantity is also assumed.

In suspension polymerization methods, the toner particle is produced by dispersing, in an aqueous medium, a polymerizable monomer composition comprising polymerizable monomer capable of forming the binder resin, colorant, wax, and so forth, to form particles of the polymerizable monomer composition, and polymerizing the polymerizable monomer in the particles.

The toner particle may be a toner particle having a core and a shell layer present on the surface of the core. Such a structure makes it possible to suppress charging defects caused by exudation of the core to the toner particle surface.

The shell layer preferably contains at least one kind selected from the group consisting of polyester resins, styrene-acrylic copolymers, and styrene-methacrylic copolymers, wherein the incorporation of a polyester resin is more preferred.

The amount of resin that forms the shell layer, considered per 100 mass parts of the resin that forms the core, is preferably at least 0.01 mass parts and not more than 20.0 mass parts and more preferably at least 0.5 mass parts and not more than 10.0 mass parts.

The use of a polyester resin for the shell layer facilitates disintegration of the externally added strontium titanate particles on the toner particle surface and facilitates dispersion of the strontium titanate particles. As a result, the developing performance during long-term repetitive use can be further improved and the occurrence of fogging and member contamination during long-term repetitive use can be better suppressed.

The weight-average molecular weight of this polyester resin is preferably at least 5,000 and not more than 50,000. A weight-average molecular weight in the indicated range facilitates further improvement in the dispersibility of the strontium titanate particles on the toner particle surface.

Vinylic polymerizable monomers are examples of polymerizable monomers capable of forming the binder resin. Specific examples are as follows:

styrene; styrene derivatives such as α-methylstyrene, β-methylstyrene, β-methylstyrene, m-methylstyrene, p-methylstyrene, and 2,4-dimethylstyrene; acrylic polymerizable monomers such as methyl acrylate, ethyl acrylate, n-propyl acrylate, isopropyl acrylate, n-butyl acrylate, isobutyl acrylate, tert-butyl acrylate, and 2-ethylhexyl acrylate; methacrylic polymerizable monomers such as methyl methacrylate, ethyl methacrylate, n-propyl methacrylate, isopropyl methacrylate, n-butyl methacrylate, isobutyl methacrylate, and tert-butyl methacrylate; esters of methylene aliphatic monocarboxylic acids; and vinyl esters such as vinyl acetate, vinyl propionate, vinyl butyrate, vinyl benzoate, and vinyl formate.

The toner particle may contain a charge control agent. Charge control agents that control toner particles to a negative chargeability and charge control agents that control toner particles to a positive chargeability are known for charge control agents, and one or two or more of the various charge control agents can be used in conformity to the type and application of the toner.

Charge control agents that control toner particles to a negative chargeability are exemplified by the following:

organometal complexes (monoazo metal complexes, acetylacetone metal complexes); metal complexes and metal salts of aromatic hydroxycarboxylic acids and aromatic dicarboxylic acids; aromatic mono- and polycarboxylic acids and their metal salts, anhydrides, and esters; and phenol derivatives such as bisphenol. A single one of these may be used or two or more may be used in combination.

Among the preceding, metal complexes and metal salts of aromatic hydroxycarboxylic acids that provide a stable charging performance are preferred.

Charge control agents that control toner particles to a positive chargeability, on the other hand, are exemplified by the following:

nigrosine and its modifications by fatty acid metal salts; quaternary ammonium salts, e.g., tributylbenzylammonium 1-hydroxy-4-naphthosulfonate and tetrabutylammonium tetrafluoroborate, and their analogs; onium salts such as phosphonium salts and their lake pigments; triphenylmethane dyes and their lake pigments (the laking agent is exemplified by phosphotungstic acid, phosphomolybdic acid, phosphotungstomolybdic acid, tannic acid, lauric acid, gallic acid, ferricyanic acid, and ferrocyanide compounds); and the metal salts of higher fatty acids. A single one of these can be used or two or more can be used in combination.

Among the preceding, nigrosine compounds and quaternary ammonium salts are preferred.

The strontium titanate particle described above is positive charging, and thus the use of a charge control agent that controls the toner particle to negative charging is more preferred because this raises the electrostatic attachment force between the toner particle and the strontium titanate particle.

The content of the charge control agent, per 100 mass parts of the binder resin or the polymerizable monomer capable of forming the binder resin, is preferably at least 0.1 mass parts and not more than 10.0 mass parts.

The use of a charge control resin is also a preferred embodiment. The negative chargeability of the toner particle surface is enhanced when the toner particle contains a charge control resin. Due to this, the electrostatic attachment force with the strontium titanate particle, which is positive charging, is raised and as a consequence migration of the strontium titanate particle from the toner particle is impeded and the development performance during long-term repetitive use is improved and the suppression of occurrence of fogging and member contamination during long-term repetitive use is facilitated.

The charge control resin preferably is a polymer that bears a sulfonic acid-type functional group. This polymer that bears a sulfonic acid-type functional group is a polymer that bears the sulfonic acid group, sulfonate salt group, or sulfonate ester group. Among these, sulfonic acid group-bearing polymers are preferred.

Specific examples here are homopolymers of a monomer such as styrenesulfonic acid, 2-acrylamido-2-methylpropanesulfonic acid, 2-methacrylamido-2-methylpropanesulfonic acid, vinylsulfonic acid, or methacrylsulfonic acid, and copolymers of such a monomer with another monomer. Also usable are polymers provided by having the sulfonic acid group in such polymers be a sulfonate salt group or an ester. The glass transition temperature (Tg) of this charge control resin is preferably at least 40° C. and not more than 90° C.

The content of the charge control resin, per 100 mass parts of the binder resin or the polymerizable monomer capable of forming the binder resin, is preferably at least 0.1 mass parts and not more than 10.0 mass parts. In addition, through its co-use with a water-soluble polymerization initiator, this charge control resin can provide additional improvements in the charging state of the toner particle.

Assigning A (atomic %) to the amount of carbon atoms present on the surface of the toner particle as measured with an x-ray photoelectron spectrometer, and assigning E (atomic %) to the amount of sulfur atoms present on the surface of the toner particle as measured with an x-ray photoelectron spectrometer, E/A preferably satisfies the following formula (1) and more preferably satisfies the following formula (1)'.

E/A can be adjusted, for example, by incorporating the aforementioned charge control resin into the toner particle.

$$3\times10^{-4}\leq E/A\leq 50\times10^{-4} \quad (1)$$

$$5\times10^{-4}\leq E/A\leq 30\times10^{-4} \quad (1)'$$

By adopting the indicated range for E/A, the electrostatic attachment force between the toner particle and strontium titanate particle is increased further and migration of the strontium titanate particle from the toner particle is impeded. In addition, because this also exhibits an excellent resistance-regulating function, the developing performance is additionally improved and a more thorough suppression of the occurrence of fogging and member contamination is facilitated.

The toner particle may contain a wax. This wax can be exemplified by the following:

petroleum waxes such as paraffin waxes, microcrystalline waxes, and petrolatum, and their derivatives; montan wax and its derivatives; hydrocarbon waxes produced by the Fischer-Tropsch process, and their derivatives; polyolefin waxes, such as polyethylene and polypropylene, and their derivatives; natural waxes such as carnauba wax and candelilla wax, and their derivatives; higher aliphatic alcohols; fatty acids such as stearic acid and palmitic acid; acid amide waxes; and ester waxes.

The derivatives here can be exemplified by oxides and by block copolymers and graft modifications with vinylic monomers.

The wax content, per 100.0 mass parts of the binder resin or polymerizable monomer capable of forming the binder resin, is preferably at least 2.0 mass parts and not more than 15.0 mass parts and more preferably at least 2.0 mass parts and not more than 10.0 mass parts.

The toner particle may contain a colorant.

Black colorants may be, for example, carbon black, a magnetic body, or a black colorant provided by color matching a yellow colorant, magenta colorant, and cyan colorant as described in the following to give a black color.

Yellow colorants can be exemplified by condensed azo compounds, isoindolinone compounds, anthraquinone compounds, azo metal complexes, methine compounds, and allylamide compounds.

Specific examples are C. I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are C. I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269 and C. I. Pigment Violet 19.

Cyan colorants can be exemplified by copper phthalocyanine compounds and their derivatives, anthraquinone compounds, and basic dye lake compounds.

Specific examples are C. I. Pigment Blue 1, 7, 15, 15:1, 15:2, 15:3, 15:4, 60, 62, and 66.

A single one of these colorants may be used or a mixture may be used, and these colorants may also be used in a solid solution state.

The colorant may be selected considering the hue angle, chroma, lightness, lightfastness, OHP transparency, and dispersibility in the toner particle.

The colorant content is preferably at least 1 mass part and not more than 20 mass parts per 100 mass parts of the binder resin or polymerizable monomer capable of forming the binder resin.

The toner particle may also be made into a magnetic toner particle by the incorporation of a magnetic body as colorant. The magnetic body can be exemplified by iron oxides such as magnetite, hematite, and ferrite; metals such as iron, cobalt, and nickel; and alloys and mixtures of these metals with metals such as aluminum, copper, magnesium, tin, zinc, beryllium, calcium, manganese, selenium, titanium, tungsten, and vanadium.

The magnetic body is preferably a magnetic body that has undergone surface modification.

In the case of preparation of a magnetic toner by a polymerization method, a hydrophobic treatment is preferably executed on the magnetic body using a surface modifier that is a substance that does not inhibit the polymerization. This surface modifier can be exemplified by silane coupling agents and titanium coupling agents.

The number-average particle diameter of the magnetic body is preferably not more than 2.0 μm and is more preferably at least 0.1 μm and not more than 0.5 μm.

The content of the magnetic body, per 100 mass parts of the binder resin or polymerizable monomer capable of forming the binder resin, is preferably at least 20 mass parts and not more than 200 mass parts and is more preferably at least 40 mass parts and not more than 150 mass parts.

On the other hand, an example of a production method for producing the toner particle by a pulverization procedure is described in the following.

In a starting material mixing step, the materials constituting the toner particle, e.g., binder resin, colorant, wax, and so forth, are metered out in prescribed amounts and are blended and mixed.

The mixing device can be exemplified by the double cone mixer, V-mixer, drum mixer, Super mixer, FM mixer, Nauta mixer, and Mechano Hybrid (Nippon Coke & Engineering Co., Ltd.).

The mixed materials are then melt-kneaded in order to disperse the colorant, wax, and so forth in the binder resin. A batch kneader, such as a pressure kneader or a Banbury mixer, or a continuous kneader can be used in the melt-kneading step. Single-screw and twin-screw extruders are the mainstream here because they offer the advantage of supporting continuous production. Examples in this regard are the Model KTK twin-screw extruder (Kobe Steel, Ltd.), Model TEM twin-screw extruder (Toshiba Machine Co., Ltd.), PCM kneader (Ikegai Corporation), Twin Screw Extruder (KCK), Co-Kneader (Buss AG), and Kneadex (Nippon Coke & Engineering Co., Ltd.). The resin composition provided by melt-kneading may be rolled out using, for example, a two-roll mill, and may be cooled with, for example, water, in a cooling step.

The resulting cooled material is then pulverized in a pulverization step until the desired particle diameter is reached.

In the pulverization step, a coarse pulverization is performed using a grinder, for example, a crusher, hammer mill, or feather mill. This may be followed by a fine pulverization using a pulverizer such as a Kryptron System (Kawasaki Heavy Industries, Ltd.), Super Rotor (Nisshin Engineering Inc.), or Turbo Mill (Freund-Turbo Corporation) or using an air jet system.

The toner particle is then obtained as necessary by carrying out classification using a sieving apparatus or a classifier, e.g., an inertial classification system such as the Elbow Jet (Nittetsu Mining Co., Ltd.), a centrifugal classification system such as the Turboplex (Hosokawa Micron Corporation), and TSP Separator (Hosokawa Micron Corporation), or Faculty (Hosokawa Micron Corporation).

The toner particle may also be subjected to spheronizing. For example, after pulverization, the toner particle may be subjected to a spheronizing treatment using a Hybridization System (Nara Machinery Co., Ltd.), Mechanofusion System (Hosokawa Micron Corporation), Faculty (Hosokawa Micron Corporation), or Meteo Rainbow MR Type (Nippon Pneumatic Mfg. Co., Ltd.).

The toner can be obtained by mixing the strontium titanate particle and as necessary another external additive with the toner particle. The mixer used to mix the external additive can be exemplified by the FM mixer (Nippon Coke & Engineering Co., Ltd.), Super mixer (Kawata Mfg. Co., Ltd.), Nobilta (Hosokawa Micron Corporation), and Hybridizer (Nara Machinery Co., Ltd.).

The coarse particles may be sieved off after the external additive has been admixed. The sieving apparatus used for this purpose can be exemplified by the following:

Ultrasonic (Koei Sangyo Co., Ltd.), Rezona Sieve and Gyro-Sifter (Tokuju Corporation), Vibrasonic System (Dalton Corporation), Soniclean (Sintokogio, Ltd.), Turbo Screener (Freund-Turbo Corporation), and Microsifter (Makino Mfg. Co., Ltd.).

The toner may contain another external additive in addition to the strontium titanate particle. In particular, a flowability improver may be added as the external additive in order to improve the flowability and charging performance of the toner.

The following, for example, can be used as this flowability improver:

a fluororesin powder such as vinylidene fluoride fine powder and polytetrafluoroethylene fine powder; silica fine particles such as wet-produced silica and dry-produced silica; titanium oxide fine particles; alumina fine particles; hydrophobed fine particles as provided by the execution of a surface treatment on the aforementioned fine particles using a hydrophobic treatment agent such as a silane compound, titanium coupling agent, or silicone oil; oxides such as zinc oxide and tin oxide; composite oxides such as barium titanate, calcium titanate, strontium zirconate, and calcium zirconate; and carbonate salt compounds such as calcium carbonate and magnesium carbonate.

Preferred among the preceding are the dry-produced silica fine particles referred to as dry silica or fumed silica, which are fine particles produced by the vapor-phase oxidation of a silicon halide compound.

This dry production method, for example, uses the thermal decomposition oxidation reaction of a silicon tetrachloride gas in an oxyhydrogen flame, wherein the basic reaction formula is as follows.

$$SiCl_4+2H_2+O_2 \rightarrow SiO_2+4HCl$$

Composite fine particles of silica and another metal oxide may also be obtained in this production process using a combination of the silicon halide compound with another metal halide compound such as aluminum chloride or titanium chloride, and these composite fine particles are also encompassed by the silica fine particle concept.

The flowability improver preferably has a number-average primary particle diameter of at least 5 nm and not more than 30 nm because this enables a high charging performance and a high flowability to be established.

The silica fine particle is more preferably a hydrophobed silica fine particle as provided by the execution of a surface treatment using a hydrophobic agent as described above.

The flowability improver preferably has a specific surface area, as measured by nitrogen adsorption by the BET procedure, of at least 30 $m^2/g$ and not more than 300 $m^2/g$.

The content of the flowability improver, per 100 mass parts of the toner particle, is preferably at least 0.01 mass parts and not more than 3.0 mass parts for the total amount of the flowability improver.

The methods used to measure the various properties related to the toner and other materials are described in the following.

The properties of the strontium titanate particle are measured using the toner as the sample.

When property measurement is performed on strontium titanate particles or toner particles from a toner to which strontium titanate particles have been externally added, the measurement may be carried out after separating the strontium titanate particles and other external additives from the toner.

The toner is subjected to ultrasonic dispersion in methanol to separate the strontium titanate particles and other external additive, and standing at quiescence is carried out for 24 hours. The sedimented toner particles are separated from the strontium titanate particles and other external additive dispersed in the supernatant, recovered, and thoroughly dried to isolate the toner particles. The supernatant can be processed by centrifugal separation to isolate the strontium titanate particles.

<Measurement of the Number-Average Primary Particle Diameter of the Strontium Titanate Particle>

The number-average primary particle diameter of the strontium titanate particle is measured using a "JEM-2800" transmission electron microscope (JEOL Ltd.).

The toner to which the strontium titanate particle has been externally added is observed, and, in a field enlarged by a maximum of 200,000×, the long diameter of the primary particle of 100 randomly selected strontium titanate particles is measured and the number-average particle diameter is determined therefrom. The observation magnification may be adjusted as appropriate in accordance with the size of the strontium titanate particles.

<Measurement of the Diffraction Peaks for the Strontium Titanate Particle>

The diffraction peaks for the strontium titanate particle are measured using a "SmartLab" powder x-ray diffractometer (Rigaku Corporation, a powerful horizontal sample-type x-ray diffractometer).

Sb/Sa is calculated from the obtained peaks using the "PDXL2 (version 2.2.2.0)" analytical software provided with this instrument.

The toner or the strontium titanate particles isolated from the toner are used as the measurement sample, and the measurement is carried out using the following procedure. The produced strontium titanate particles were also measured in the examples given below.

(Sample Preparation)

Measurement is carried out after the measurement sample has been uniformly introduced into a 0.5 mm-diameter Boro-Silicate capillary (W. Muller USA Inc.).

(Measurement Conditions)

tube: Cu
optical system: CBO-E
sample platform: capillary sample platform
detector: D/tex Ultra250 detector
voltage: 45 kV
current: 200 mA
start angle: 10°
final angle: 90°
sampling width: 0.02°
speed measurement time set value: 10
IS: 1 mm
RS1: 20 mm
RS2: 20 mm
attenuator: Open
set value for capillary rotation: 100

The initial settings on the instrument are used for the other conditions.

(Analysis)

Peak separation processing is first carried out on the obtained peaks using the "PDXL2" software provided with the instrument. Peak separation is determined by carrying out optimization using the "split Voigt function" that can be selected with the PDXL, and the obtained integral intensity values are used.

The 2θ value of the diffraction peak top and its area are thereby determined. Sb/Sa is calculated from the peak areas at the prescribed 2θ values. When a large deviation occurs here between the calculated results for peak separation and the actually measured spectrum, processing is performed, for example, setting the baseline manually, and adjustment is made to bring the calculated result into agreement with the actually measured spectrum.

<Measurement of the Sr/Ti (Molar Ratio) of the Strontium Titanate Particle>

The Sr and Ti contents in the strontium titanate particle are measured using a wavelength-dispersive x-ray fluorescence analyzer (Axios Advanced, PANalytical B.V.).

1 g of the sample is weighed onto a specialized film pasted in a specialized powder measurement cup, as recommended by PANalytical B.V., and the elements from Na to U are measured on the strontium titanate particle by the FP method at atmospheric pressure under a helium atmosphere.

In this case, all of the detected elements are assumed to be present as the oxide, and, using their total mass as 100%, the SrO content and $TiO_2$ content (mass %) are determined as the values as the oxide with respect to the total mass using Spectra Evaluation (version 5.0L) software.

After this, Sr/Ti (mass ratio) is determined by subtracting the oxygen from the quantitative results, and Sr/Ti (molar ratio) is then determined from the atomic weights of the respective elements.

The sample used is obtained by isolating the strontium titanate particles from the toner. In the examples given below, the produced strontium titanate particles are also measured.

<Measurement of the Average Circularity of the Primary Particles of the Strontium Titanate Particles>

The average circularity of the primary particle of the strontium titanate particles is measured using a "JEM-2800" transmission electron microscope (JEOL Ltd.).

The observation is performed on toner to which the strontium titanate particles have been externally added, and the determination is carried out as follows.

The observation magnification is adjusted as appropriate depending on the size of the strontium titanate particles.

Using "Image-Pro Plus 5.1J" (Media Cybernetics, Inc.) image processing software, the circle-equivalent diameter of 100 randomly selected strontium titanate particles and the peripheral length of the particles are measured in a field magnified by a maximum 200,000× and the average circularity is calculated. The circle-equivalent diameter is the diameter of the circle having the same area as the projected area of the particle.

The circularity is calculated using the following formula, and the average circularity is taken to be the arithmetic average value thereof.

$$\text{circularity} = \text{circle-equivalent diameter} \times 3.14 / \text{peripheral length of the particle} \quad \text{(formula)}$$

The external additive was confirmed to be strontium titanate by STEM-EDS measurement.

The measurement conditions are as follows.

Model JEM-2800 transmission electron microscope: acceleration voltage=200 kV

EDS detector: JED-2300T (JEOL Ltd., element area=100 $mm^2$)

EDS analyzer: Noran System 7 (Thermo Fisher Scientific Inc.)

x-ray storage rate: 10,000 to 15,000 cps dead time: The EDS analysis (cumulative number=100 or measurement time=5 minutes) is carried out with the electron beam dose adjusted to provide 20% to 30%.

<Measurement of the Hydrophobicity (Volume %) of the Strontium Titanate Particle>

The hydrophobicity (volume %) of the strontium titanate particle is measured using a "WET-100P" powder wettability tester (Rhesca Co., Ltd.).

A fluororesin-coated spindle-shaped stir bar having a length of 25 mm and a maximum barrel diameter of 8 mm is introduced into a cylindrical glass vessel having a diameter of 5 cm and a thickness of 1.75 mm.

70 mL of aqueous methanol composed of 50 volume % methanol and 50 volume % water is introduced into the cylindrical glass vessel. 0.5 g of the strontium titanate particles isolated from the toner is then added and the vessel is set in the powder wettability tester.

While stirring at a rate of 200 rpm using a magnetic stirrer, methanol is added through the powder wettability tester into the liquid at a rate of 0.8 mL/min.

The transmittance of light at a wavelength of 780 nm is measured, and the hydrophobicity is taken to be the value given by the volume percent of methanol when the transmittance reaches 50%(=(volume of methanol/volume of mixture)×100). The starting volume ratio between the methanol and water may be adjusted as appropriate in conformity with the hydrophobicity of the sample. In addition, the measurement is also carried out in the following examples on the produced strontium titanate particles.

<Measurement of the Coverage Ratio of the Toner Surface by the Strontium Titanate Particles>

The coverage ratio of the toner surface by the strontium titanate particles (given simply as the "coverage ratio" in Table 3) is calculated using the formula (2) below after measuring the toner using the following conditions.

measurement instrument: Quantum 2000 x-ray photoelectron spectrometer (Ulvac-Phi, Inc.)

x-ray source: monochrome Al Kα x-ray setting: 100 μmØ (25 W (15 kV))

photoelectron extraction angle: 45° neutralization conditions: combined use of neutralizing gun and ion gun region of analysis: 300×200 μm pass energy: 58.70 eV step size: 0.125 eV analysis software: MultiPak (Physical Electronics Inc.)

The peak for Ti 2p (B.E. 452 to 468 eV) is used to calculate the quantitative value for the Ti atom. The quantitative value for the element Ti thereby obtained is designated Z1.

Then, proceeding as in the aforementioned elemental analysis, elemental analysis is performed on the strontium titanate particle itself, and the quantitative value for the element Ti thereby obtained is designated Z2. The coverage ratio of the toner surface by the strontium titanate particle is calculated using the following formula (2).

$$\text{coverage ratio} = Z1/Z2 \times 100 \quad (2)$$

<Measurement of the Average Circularity of the Toner>

The average circularity of the toner is measured using an "FPIA-3000" (Sysmex Corporation), a flow-type particle image analyzer, and using the measurement and analysis conditions from the calibration process.

The specific measurement method is as follows.

First, approximately 20 mL of deionized water from which solid impurities and so forth have been preliminarily removed, is introduced into a glass container. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

Approximately 0.02 g of the measurement sample is added and a dispersion treatment is carried out for 2 minutes using an ultrasonic disperser to provide a dispersion to be used for the measurement. Cooling is carried out as appropriate during this process in order to have the temperature of the dispersion be 10° C. to 40° C.

A benchtop ultrasonic cleaner/disperser that has an oscillation frequency of 50 kHz and an electrical output of 150 W (for example, the "VS-150" (Velvo-Clear)) is used as the ultrasonic disperser, and a prescribed amount of deionized water is introduced into the water tank and approximately 2 mL of Contaminon N is added to the water tank.

The flow particle image analyzer fitted with a "LUCPLFLN" objective lens (20×, numerical aperture: 0.40) is used for the measurement, and "PSE-900A" (Sysmex Corporation) particle sheath is used for the sheath solution. The dispersion prepared according to the procedure described above is introduced into the flow particle image analyzer and 2,000 of the toner are measured according to total count mode in HPF measurement mode.

The average circularity of the toner is determined with the binarization threshold value during particle analysis set at 85% and the analyzed particle diameter limited to a circle-equivalent diameter of at least 1.977 μm and less than 39.54 μm.

For this measurement, automatic focal point adjustment is performed prior to the start of the measurement using reference latex particles (for example, a dilution with deionized water of "RESEARCH AND TEST PARTICLES Latex Microsphere Suspensions 5100A", Duke Scientific Corporation). After this, focal point adjustment is preferably performed every two hours after the start of measurement.

In the examples, the flow-type particle image analyzer used had been calibrated by the Sysmex Corporation and had been issued a calibration certificate by the Sysmex Corporation. The measurements were carried out under the same measurement and analysis conditions as when the calibration certification was received, with the exception that the analyzed particle diameter was limited to a circle-equivalent diameter of at least 1.977 μm and less than 39.54 μm.

<Measurement of the Glass Transition Temperature (Tg) of the Toners>

The glass transition temperature of the toners is measured based on ASTM D3418-82 using a "Q1000" (TA Instruments) differential scanning calorimeter.

Temperature correction in the instrument detection section is performed using the melting points of indium and zinc, and the amount of heat is corrected using the heat of fusion of indium.

Specifically, approximately 5 mg of the sample is exactly weighed out and this is introduced into an aluminum pan, and the measurement is run at a ramp rate of 10° C./min in the measurement temperature range of at least 30° C. and not more than 200° C. using an empty aluminum pan as reference.

The measurement is carried out by initially raising the temperature to 200° C., then cooling to 30° C. at a ramp down rate of 10° C./min, and then reheating at a ramp rate of 10° C./min.

Using the DSC curve obtained in this second heating process, the glass transition temperature (Tg) is taken to be the point at the intersection between the DSC curve and the line for the midpoint for the baselines for prior to and subsequent to the appearance of the change in the specific heat.

<Measurement of E/A on the Toner Particle Surface>

The ratio (E/A) of the amount of sulfur atoms (E (atomic %)) to the amount of carbon atoms (A (atomic %)) present on the toner particle surface is determined based on the analytical results from the execution of compositional analysis of the toner particle surface using a "Model 1600S" x-ray photoelectron spectrometer (ESCA) (Physical Electronics Industries, Inc.).

The measurement conditions are an x-ray source of MgKα (400 W) and a spectral region of 800 μmØ.

Using the relative sensitivity factors provided by Physical Electronics Industries, Inc., the surface atomic concentration (atomic %) is calculated from the measured peak intensities for the individual atoms and is taken to be the amount of the particular atom.

The ranges used in the measurements for the measured peak tops for the particular atoms are carbon atom: 283 to 293 eV and sulfur atom: 166 to 172 eV.

EXAMPLES

The present invention is described in additional detail using the examples and comparative examples provided below; however, the present invention is in no way limited to or by these. Unless specifically indicated otherwise, the number of parts in the examples and comparative examples is on a mass basis in all instances.

Strontium titanate particles were produced proceeding as follows. The properties of strontium titanate particles 1 to 15 are given in Table 1.

<Strontium Titanate Particle 1 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.16 mol of an aqueous strontium chloride solution was added to this deflocculated metatitanic acid slurry to bring Sr/Ti (molar ratio) to 1.15, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 1. A transmission electron micrograph of strontium titanate particle 1 is given in the FIGURE.

<Strontium Titanate Particle 2 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.16 mol of an aqueous strontium chloride solution was added to this deflocculated metatitanic acid slurry to bring Sr/Ti (molar ratio) to 1.15, and the $TiO_2$ concentration was then adjusted to 1.083 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 2.

<Strontium Titanate Particle 3 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.16 mol of an aqueous strontium chloride solution was added to this deflocculated metatitanic acid slurry to bring Sr/Ti (molar ratio) to 1.15, and the $TiO_2$ concentration was then adjusted to 1.015 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 3.

<Strontium Titanate Particle 4 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.16 mol of an aqueous strontium chloride solution was added to this deflocculated metatitanic acid slurry to bring Sr/Ti (molar ratio) to 1.15, and the $TiO_2$ concentration was then adjusted to 0.988 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 4.

<Strontium Titanate Particle 5 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.16 mol of an aqueous strontium chloride solution was added to this deflocculated metatitanic acid slurry to bring Sr/Ti (molar ratio) to 1.15, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 15 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 5.

<Strontium Titanate Particle 6 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.16 mol of an aqueous strontium chloride solution was added to this deflocculated metatitanic acid slurry to bring Sr/Ti (molar ratio) to 1.15, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 5 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 6.

<Strontium Titanate Particle 7 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.01 mol of an aqueous strontium chloride solution was added to this deflocculated metatitanic acid slurry to bring Sr/Ti (molar ratio) to 1.07, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 7.

<Strontium Titanate Particle 8 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.54 mol of an aqueous strontium chloride solution was added to this deflocculated metatitanic acid slurry to bring Sr/Ti (molar ratio) to 1.35, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 8.

<Strontium Titanate Particle 9 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.54 mol of an aqueous strontium chloride solution was added to this deflocculated metatitanic acid slurry to bring Sr/Ti (molar ratio) to 1.35, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 70° C.; sodium stearate was added at 4.0 mass % with reference to the solids fraction; and stirring and holding were continued for 1 hour. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 9.

<Strontium Titanate Particle 10 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.54 mol of an aqueous strontium chloride solution was added to this deflocculated metatitanic acid slurry to bring Sr/Ti (molar ratio) to 1.35, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

Using a Hybridizer (Nara Machinery Co., Ltd.), the dry product was then subjected three times to a 3-minute treatment at 6,000 rotations.

Hydrochloric acid was added to the dry product until the pH reached 0.1 and stirring was continued for 1 hour. The obtained precipitate was washed by decantation, and the cake obtained by filtration and washing was dried for 8 hours in the atmosphere at 120° C. to obtain strontium titanate particle 10.

<Strontium Titanate Particle 11 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid. 1.88 mol as $TiO_2$ of the desulfurized and deflocculated metatitanic acid was recovered and was introduced into a 3 L reactor. 2.16 mol of an aqueous strontium chloride solution was added to this deflocculated metatitanic acid slurry to bring Sr/Ti (molar ratio) to 1.15, and the $TiO_2$ concentration was then adjusted to 1.039 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 1 hour. The resulting precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 11.

<Strontium Titanate Particle 12 Production Example>

A metatitanic acid slurry obtained by the hydrolysis of an aqueous titanyl sulfate solution was washed with an aqueous alkali solution.

Hydrochloric acid was then added to the metatitanic acid slurry to adjust the pH to 0.65 and thereby obtain a titania sol dispersion.

The pH of the dispersion was adjusted to 4.5 by adding NaOH to the titania sol dispersion, and washing was repeated until the electrical conductivity of the supernatant reached 70 μS/cm.

Strontium hydroxide octahydrate was added at 0.97-fold on a molar basis to the metatitanic acid slurry, followed by introduction into a stainless steel reactor and substitution with nitrogen gas.

Distilled water was added to bring to 0.5 mol/L as $TiO_2$. The slurry was heated in a nitrogen atmosphere to 83° C. at 6.5° C./h, and a reaction was run for 6 hours after 83° C. had been reached. The resulting precipitate was washed by decantation followed by filtration and separation and then drying for 8 hours in the atmosphere at 120° C. to obtain strontium titanate particle 12.

<Strontium Titanate Particle 13 Production Example>

Metatitanic acid produced by the sulfate method was subjected to an iron-removing bleaching treatment; this was followed by bringing the pH to 9.0 by the addition of an aqueous sodium hydroxide solution and performing a desulfurization treatment; and neutralization with hydrochloric acid was subsequently carried out to pH 5.8 and filtration and water washing were performed. Once the washing had been completed, water was added to the cake to produce a slurry of 1.85 mol/L as $TiO_2$, followed by the execution of a deflocculation treatment by adjusting the pH to 1.0 by the addition of hydrochloric acid.

1.88 mol as $TiO_2$ of the desulfurized and deflocculated metatitanic acid was recovered and was introduced into a 3 L reactor. 2.16 mol of an aqueous strontium chloride solution was added to this deflocculated metatitanic acid slurry to bring Sr/Ti (molar ratio) to 1.15, and the $TiO_2$ concentration was then adjusted to 0.960 mol/L.

Then, after heating to 90° C. while stirring and mixing, 440 mL of a 10 mol/L aqueous sodium hydroxide solution was added over 45 minutes followed by continuing to stir for 1 hour at 95° C. to finish the reaction.

The reaction slurry was cooled to 50° C.; hydrochloric acid was added until the pH reached 5.0; and stirring was continued for 20 minutes. The resulting precipitate was washed by decantation, separated by filtration, and subsequently dried for 8 hours in the atmosphere at 120° C.

300 g of the dry product was then introduced into a dry-method powder compositing device (Nobilta NOB-130, Hosokawa Micron Corporation). Treatment was carried out for 10 minutes at a treatment temperature of 30° C. and 90 m/sec for the rotary treatment blade.

Hydrochloric acid was added to the dry product until the pH reached 0.1 and stirring was continued for 1 hour. The obtained precipitate was washed by decantation.

The precipitate-containing slurry was adjusted to 40° C.; the pH was adjusted to 2.5 by the addition of hydrochloric acid; n-octyltriethoxysilane was added at 4.0 mass % with reference to the solids fraction; and stirring and holding were continued for 10 hours. The pH was adjusted to 6.5 by the addition of a 5 mol/L sodium hydroxide solution and stirring was continued for 1 hour, after which the cake obtained by filtration and washing was dried for 8 hours in the atmosphere at 120° C. to obtain strontium titanate particle 13.

<Strontium Titanate Particle 14 Production Example>

A hydrous titanium oxide was obtained by hydrolysis by the addition of aqueous ammonia to an aqueous titanium tetrachloride solution; this hydrous titanium oxide was washed with pure water; and sulfuric acid was added, at 0.25% as $SO_3$ with reference to the hydrous titanium oxide, to a slurry of the hydrous titanium oxide.

Hydrochloric acid was then added to the hydrous titanium oxide slurry to adjust the pH to 0.65 and thereby obtain a titania sol dispersion. The pH of the dispersion was adjusted to 4.7 by adding NaOH to the titania sol dispersion, and washing was repeated until the electrical conductivity of the supernatant reached 50 μS/cm.

Strontium hydroxide octahydrate was added at 0.95-fold on a molar basis to the hydrous titanium oxide, followed by introduction into a stainless steel reactor and substitution with nitrogen gas. Distilled water was added to bring to 0.6 mol/L as $SrTiO_3$.

The slurry was heated in a nitrogen atmosphere to 65° C. at 10° C./h, and a reaction was run for 8 hours after 65° C. had been reached. After the reaction, cooling was carried out to room temperature; the supernatant was removed; and washing with pure water was subsequently carried out repeatedly.

Operating under a nitrogen atmosphere, the slurry was introduced into an aqueous solution prepared by the dissolution of sodium stearate at 2 mass % with reference to the solids fraction in the slurry. While stirring, an aqueous magnesium sulfate solution was added dropwise to precipitate magnesium stearate on the perovskite crystal surface.

The slurry was repeatedly washed with pure water and then filtered on a nutsche filter and the resulting cake was dried to obtain the magnesium stearate-surface treated strontium titanate particle 14.

<Strontium Titanate Particle 15 Production Example>

A hydrous titanium oxide slurry obtained by the hydrolysis of an aqueous titanyl sulfate solution was washed with an aqueous alkali solution. Hydrochloric acid was then added to the hydrous titanium oxide slurry to adjust the pH to 4.0 and thereby obtain a titania sol dispersion. The pH of the dispersion was adjusted to 8.0 by adding NaOH to the titania sol dispersion, and washing was repeated until the electrical conductivity of the supernatant reached 100 μS/cm.

Strontium hydroxide octahydrate was added at 1.02-fold on a molar basis to the hydrous titanium oxide, followed by introduction into a stainless steel reactor and substitution with nitrogen gas.

Distilled water was added to bring to 0.3 mol/L as $SrTiO_3$. The slurry was heated in a nitrogen atmosphere to 90° C. at 30° C./h, and a reaction was run for 5 hours after 90° C. had been reached. Cooling to room temperature was carried out after the reaction, followed by removal of the supernatant, repeated washing with pure water, and then filtration using a nutsche filter. The resulting cake was dried to obtain strontium titanate particle 15.

TABLE 1

| Strontium titanate particle No. | Number-average primary particle diameter (nm) | X-ray diffraction: Presence/absence of peak at 39.700° ± 0.150° | X-ray diffraction: Presence/absence of peak at 46.200° ± 0.150° | Sb/Sa | Sr/Ti (molar ratio) | Average circularity | Hydrophobicity (volume %) |
|---|---|---|---|---|---|---|---|
| 1 | 35 | Present | Present | 2.03 | 0.79 | 0.872 | 75 |
| 2 | 15 | Present | Present | 1.98 | 0.75 | 0.915 | 73 |
| 3 | 47 | Present | Present | 2.04 | 0.80 | 0.848 | 76 |
| 4 | 58 | Present | Present | 2.06 | 0.81 | 0.843 | 77 |
| 5 | 32 | Present | Present | 1.82 | 0.73 | 0.874 | 75 |
| 6 | 37 | Present | Present | 2.27 | 0.82 | 0.868 | 74 |
| 7 | 38 | Present | Present | 1.80 | 0.67 | 0.866 | 77 |
| 8 | 42 | Present | Present | 2.22 | 0.86 | 0.850 | 76 |
| 9 | 42 | Present | Present | 2.22 | 0.86 | 0.850 | 62 |
| 10 | 42 | Present | Present | 2.22 | 0.86 | 0.850 | 0 |
| 11 | 39 | Present | Present | 2.34 | 0.97 | 0.785 | 72 |
| 12 | 80 | Present | Present | 2.21 | 0.88 | 0.937 | 0 |
| 13 | 65 | Present | Present | 2.19 | 0.84 | 0.833 | 77 |
| 14 | 60 | Present | Present | 2.35 | 0.95 | 0.777 | 59 |
| 15 | 25 | Present | Present | 2.33 | 1.02 | 0.791 | 0 |

<Charge Control Resin 1 Production Example>

250 parts of methanol, 150 parts of 2-butanone, and 100 parts of 2-propanol as solvents, and 83 parts of styrene, 12 parts of butyl acrylate, and 5 parts of 2-acrylamido-2-methylpropanesulfonic acid as monomers, were added to a pressurizable reactor equipped with a reflux condenser, stirrer, thermometer, nitrogen introduction line, dropwise addition apparatus, and pressure reduction apparatus, and heating was performed to the reflux temperature while stirring.

To this was added dropwise over 30 minutes a solution of 0.45 parts of the polymerization initiator t-butyl peroxy-2-ethylhexanoate diluted with 20 parts of 2-butanone, and stirring was continued for 5 hours. Then, a solution of 0.28 parts of t-butyl peroxy-2-ethylhexanoate diluted with 20 parts of 2-butanone was added dropwise over 30 minutes and stirring was carried out for an additional 5 hours to complete the polymerization.

The polymerization solvent was distilled off under reduced pressure, and charge control resin 1 was obtained by coarsely pulverizing the resulting polymer to 100 μm and below using a cutter mill fitted with a 150-mesh screen. The glass transition temperature (Tg) of the obtained polymer was approximately 70° C.

Toner particles were produced as described in the following. The properties of the resulting toner particles 1 to 9 are given in Table 2.

<Toner Particle 1 Production Example>

710 parts of deionized water and 850 parts of a 0.1 mol/L aqueous $Na_3PO_4$ solution were added to a four-neck vessel, and holding at 60° C. was carried out while stirring at 12,000 rpm using a T. K. Homomixer high-speed stirrer (Tokushu Kika Kogyo Co., Ltd.). To this was gradually added 68 parts of a 1.0 mol/L aqueous $CaCl_2$ solution to prepare an aqueous medium that contained a dispersion stabilizer.

| | |
|---|---|
| styrene | 124 parts |
| n-butyl acrylate | 36 parts |
| copper phthalocyanine pigment (Pigment Blue 15:3) | 13 parts |
| polyester resin 1 (terephthalic acid-propylene oxide-modified bisphenol A (2 mol adduct) copolymer, acid value: 10 mg KOH/g, glass transition temperature (Tg): 70° C., weight-average molecular weight (Mw): 10,500) | 10 parts |

-continued

| | |
|---|---|
| charge control resin 1 | 2 parts |
| Fischer-Tropsch wax (melting point: 78° C.) | 15 parts |

These materials were stirred for 3 hours using an attritor (Nippon Coke & Engineering Co., Ltd.), and the individual components were thereby dispersed in the polymerizable monomer to prepare a monomer mixture.

20.0 parts (50% toluene solution) of the polymerization initiator 1,1,3,3-tetramethylbutyl peroxy-2-ethylhexanoate was added to the monomer mixture to prepare a polymerizable monomer composition.

The polymerizable monomer composition was introduced into the aqueous medium, and granulation was carried out for 5 minutes while holding the rotation rate of the stirrer at 10,000 rpm. The high-speed stirrer was then changed over to a propeller-type stirrer; the internal temperature was raised to 70° C.; and a reaction was run for 6 hours while gently stirring.

The vessel interior was then raised to a temperature of 80° C.; holding was carried out for 4 hours; and cooling was subsequently performed to obtain a slurry. Dilute hydrochloric acid was added to the slurry-containing vessel to eliminate the dispersion stabilizer. Filtration, washing, and drying then gave the toner particle 1.

<Toner Particle 2 Production Example>

A toner particle 2 was obtained proceeding as in the Toner Particle 1 Production Example, but changing the following: polyester resin 1 was changed to polyester resin 2 (terephthalic acid-propylene oxide-modified bisphenol A (2 mol adduct) copolymer, acid value: 13 mg KOH/g, glass transition temperature (Tg): 67° C., weight-average molecular weight (Mw): 9,800), and the granulation conditions after introduction of the polymerizable monomer composition into the aqueous dispersion medium were changed to granulation for 8 minutes while maintaining the stirrer rotation rate at 7,500 rpm.

<Toner Particle 3 Production Example>

A toner particle 3 was obtained proceeding as in the Toner Particle 1 Production Example, but changing the following: polyester resin 1 was changed to polyester resin 3 (terephthalic acid-propylene oxide-modified bisphenol A (2 mol adduct) copolymer, acid value: 5 mg KOH/g, glass transition temperature (Tg): 71° C., weight-average molecular weight (Mw): 11,800), and the granulation conditions after introduction of the polymerizable monomer composition into the aqueous dispersion medium were changed to granulation for 5 minutes while maintaining the stirrer rotation rate at 12,000 rpm.

<Toner Particle 4 Production Example>

A toner particle 4 was obtained proceeding as in the Toner Particle 1 Production Example, but changing the amount of styrene addition from 124 parts to 130 parts and changing the amount of n-butyl acrylate addition from 36 parts to 30 parts.

<Toner Particle 5 Production Example>

A toner particle 5 was obtained proceeding as in the Toner Particle 1 Production Example, but changing the amount of styrene addition from 124 parts to 115 parts and changing the amount of n-butyl acrylate addition from 36 parts to 45 parts.

<Toner Particle 6 Production Example>

A toner particle 6 was obtained proceeding as in the Toner Particle 1 Production Example, but changing the amount of styrene addition from 124 parts to 135 parts and changing the amount of n-butyl acrylate addition from 36 parts to 25 parts.

<Toner Particle 7 Production Example>

A toner particle 7 was obtained proceeding as in the Toner Particle 1 Production Example, but changing the amount of styrene addition from 124 parts to 110 parts and changing the amount of n-butyl acrylate addition from 36 parts to 50 parts.

<Toner Particle 8 Production Example>

A toner particle 8 was obtained proceeding as in the Toner Particle 7 Production Example, but without adding the polyester resin 1.

<Toner Particle 9 Production Example>

A toner particle 9 was obtained proceeding as in the Toner Particle 7 Production Example, but without adding the charge control resin 1.

TABLE 2

| Toner particle No. | Average circularity | Tg (° C.) | Polyester resin | Charge control resin | E/A ($\times 10^{-4}$) |
|---|---|---|---|---|---|
| 1 | 0.980 | 61.3 | Present | Present | 13 |
| 2 | 0.939 | 60.2 | Present | Present | 12 |
| 3 | 0.992 | 61.5 | Present | Present | 14 |
| 4 | 0.977 | 68.8 | Present | Present | 13 |
| 5 | 0.981 | 50.8 | Present | Present | 12 |
| 6 | 0.975 | 72.5 | Present | Present | 12 |
| 7 | 0.978 | 48.3 | Present | Present | 14 |
| 8 | 0.978 | 48.3 | Absent | Present | 13 |
| 9 | 0.978 | 49.9 | Present | Absent | 0 |

<Toner 1 Production Example>

1.5 parts of strontium titanate particle 1 and 1.5 parts of a fumed silica fine particle (BET: 200 $m^2/g$) were externally added and mixed with 100 parts of the obtained toner particle 1 using an FM10C (Nippon Coke & Engineering Co., Ltd.).

The external addition conditions were as follows: amount of toner particle charged: 1.8 kg, rotation rate: 3,600 rpm, and external addition time: 5 minutes.

This was followed by sieving across a mesh having an aperture of 200 μm to obtain the toner 1.

The properties of the toner 1 are given in Table 3. The average circularity, Tg, and E/A of the toner were the same as in Table 2. In addition, the properties of the strontium titanate particle 1 externally added to the toner were also the same as in Table 1.

Example 1

The following evaluations were performed using the resulting toner 1. The results of the evaluations are given in Tables 4-1 and 4-2.

<Machine Used for the Evaluations>

The evaluations were carried out using an HP Color LaserJet Enterprise M651n laser printer from Hewlett-Packard Company, which had been modified to operate with the process cartridge for only a single color installed. The paper used in the evaluations was CS-680 sold by Canon Marketing Japan Inc. The toner was filled into a prescribed process cartridge.

<Developing Performance>

The developing performance was evaluated in a low-temperature, low-humidity environment (temperature=10° C., relative humidity=14%), where the influence of the charging performance is readily brought out. A low-temperature, low-humidity environment also constitutes severe conditions for toner cracking because, during long-term repetitive use, the toner is less easily heated and plasticization occurs less readily.

Presuming a test of long-term repetitive use, an image output test of a total of 20,000 prints was run using a horizontal line pattern having a print percentage of 1% and using 2 prints/1 job, in a mode set such that the machine was temporarily stopped between jobs, after which the next job was started. The image density was measured on the first print and the 20,000th print.

The image density was measured by outputting a solid image in the form of a 5-mm circle and measuring the reflection density using a MacBeth densitometer (Gretag-Macbeth GmbH), which is a reflection densitometer, and using an SPI filter.

Here, a larger numerical value indicates a better developing performance.

<Fogging>

The fogging was evaluated in a low-temperature, low-humidity environment, where the influence of the charging performance is readily brought out. A low-temperature, low-humidity environment also constitutes severe conditions for toner cracking because, during long-term repetitive use, the toner is less easily heated and plasticization occurs less readily.

After output of the first and 20,000th image print in the evaluation of the developing performance, a solid white image was output and Dr-Ds was taken to be the fogging value where Ds was the worst value of the reflection density in the white background area and Dr was the average reflection density of the evaluation paper prior to image formation.

A reflection densitometer (Reflectometer Model TC-6DS, Tokyo Denshoku Co., Ltd.) was used to measure the reflection density of the white background area, and an amber light filter was used for the filter.

Here, a smaller numerical value indicates a better level of fogging.

<Post-Standing Developing Performance>

Operating in a high-temperature, high-humidity environment (temperature=30° C., relative humidity=80%), an image output test of a total of 5,000 prints was run using a horizontal line pattern having a print percentage of 1% and using 2 prints/1 job, in a mode set such that the machine was temporarily stopped between jobs, after which the next job was started.

The image density was measured on the 5,000th print. The evaluation was run in a high-temperature, high-humidity environment because this is an evaluation at more rigorous conditions with regard to maintenance of the charging performance.

A solid image in the form of a 5-mm circle was output after the 5,000th print had been output, and a solid image in the form of a 5-mm circle was also output after standing for 3 days in the high-temperature, high-humidity environment (temperature=30° C., relative humidity=80%).

The image density was measured by measuring the reflection density using an SPI filter on a MacBeth densitometer (GretagMacbeth GmbH), which is a reflection densitometer.

A better post-standing developing performance is indicated by a smaller decrement in the reflection density of the solid image after standing for 3 days relative to the reflection density of the solid image after output of the 5,000th print.

<Member Contamination>

Image defects may be occurred when the developing blade is contaminated. The developing blade contamination was evaluated by carrying out image output in a low-temperature, low-humidity environment, which is severe with respect to toner cracking, and subsequently transferring the cartridge to a high-temperature, high-humidity environment.

Transfer to the high-temperature, high-humidity environment is done because this facilitates the occurrence of the developing blade contamination caused by toner cracking.

The cartridge that had output 20,000 prints in the low-temperature, low-humidity environment evaluation of fogging was transferred into the high-temperature, high-humidity environment.

An image output test of 3,000 prints was run using a horizontal line pattern having a print percentage of 1% and using 1 print/1 job, in a mode set such that the machine was temporarily stopped between jobs, after which the next job was started.

Then, in order to facilitate the discrimination of image defects caused by developing blade contamination, a halftone image was output that exhibited an image density of 0.6 provided by aforementioned MacBeth reflection densitometer with respect to the transport direction of the evaluation paper. This image was visually inspected and the presence/absence of vertical streaks occurred along the transport direction due to developing blade contamination was evaluated based on the followed criteria.

A: White streak-shaped vertical lines are not seen at all in the image.

B: 1 or 2 thin white streak-shaped vertical lines are seen on the image.

C: 1 or 2 distinct white streak-shaped vertical lines are seen on the image.

D: 3 or more distinct white streak-shaped vertical lines are seen on the image.

<Halftone Density Uniformity>

The halftone density uniformity was evaluated in a low-temperature, low-humidity environment (temperature=10° C., relative humidity=14%), where the influence of the charging performance is readily brought out.

The evaluation was performed on the first halftone image in order to rigorously observe the influence of the charge distribution on the toner. A halftone image with a reflection density of 0.60 was output; the reflection density of the obtained image was measured at multiple points; and the halftone density unevenness was evaluated by determining the density differences between the multiple points. The evaluation criteria are given below.

A: the reflection density difference is less than 0.05

B: the reflection density difference is at least 0.05 and less than 0.10

C: the reflection density difference is at least 0.10 and less than 0.15

D: the reflection density difference is at least 0.15

<Toners 2 to 20 and Comparative Toners 1 to 5 Production Example>

Toners 2 to 20 and comparative toners 1 to 5 were obtained proceeding as in the Toner 1 Production Example, but changing the type and amount of addition of the toner particle and strontium titanate particle used as shown in Table 3 from that in the Toner 1 Production Example. The properties of toners 2 to 20 and comparative toners 1 to 5 are given in Table 3. The average circularity, Tg, and E/A of the toner for toners 2 to 20 and comparative toners 1 to 5 were the same as these values for the toner particles in Table 2. The properties of the strontium titanate particles externally added to the toner were also the same as in Table 1.

Examples 2 to 20 and Comparative Examples 1 to 5

The same evaluations as in Example 1 were performed. The results of the evaluations are given in Tables 4-1 and 4-2.

TABLE 3

| Toner No. | Toner particle No. | Strontium titanate particle Type No. | Strontium titanate particle Mass parts | Toner properties Coverage ratio (%) |
|---|---|---|---|---|
| 1 | 1 | 1 | 1.5 | 15 |
| 2 | 1 | 2 | 1.5 | 13 |
| 3 | 1 | 3 | 1.5 | 15 |
| 4 | 1 | 4 | 1.5 | 15 |
| 5 | 1 | 5 | 1.5 | 16 |
| 6 | 1 | 6 | 1.5 | 16 |
| 7 | 2 | 1 | 1.5 | 13 |
| 8 | 3 | 1 | 1.5 | 18 |
| 9 | 1 | 7 | 1.5 | 15 |
| 10 | 1 | 8 | 1.5 | 16 |
| 11 | 4 | 8 | 1.5 | 14 |
| 12 | 5 | 8 | 1.5 | 16 |
| 13 | 6 | 8 | 1.5 | 14 |

TABLE 3-continued

| Toner No. | Toner particle No. | Strontium titanate particle Type No. | Strontium titanate particle Mass parts | Toner properties Coverage ratio (%) |
|---|---|---|---|---|
| 14 | 7 | 8 | 1.5 | 16 |
| 15 | 7 | 9 | 1.5 | 15 |
| 16 | 7 | 10 | 1.5 | 15 |
| 17 | 7 | 10 | 3.0 | 33 |
| 18 | 7 | 10 | 0.4 | 7 |
| 19 | 8 | 10 | 0.4 | 4 |
| 20 | 9 | 10 | 1.5 | 15 |
| Comparative 1 | 9 | 11 | 1.5 | 16 |
| Comparative 2 | 9 | 12 | 1.5 | 11 |
| Comparative 3 | 9 | 13 | 1.5 | 15 |
| Comparative 4 | 9 | 14 | 1.5 | 16 |
| Comparative 5 | 9 | 15 | 1.5 | 16 |

TABLE 4-1

| | | Low-temperature, low-humidity environment | | | | |
|---|---|---|---|---|---|---|
| | Toner No. | Initial developing performance | Initial fogging | Initial halftone uniformity | Developing performance after 20,000 prints | Fogging after 20,000 prints |
| Example 1 | 1 | 1.42 | 0.4 | A | 1.40 | 0.4 |
| Example 2 | 2 | 1.42 | 0.4 | A | 1.40 | 0.5 |
| Example 3 | 3 | 1.41 | 0.4 | A | 1.39 | 0.4 |
| Example 4 | 4 | 1.41 | 0.6 | A | 1.34 | 0.7 |
| Example 5 | 5 | 1.42 | 0.4 | A | 1.40 | 0.4 |
| Example 6 | 6 | 1.41 | 0.6 | A | 1.34 | 0.7 |
| Example 7 | 7 | 1.39 | 0.5 | A | 1.36 | 0.7 |
| Example 8 | 8 | 1.42 | 0.4 | A | 1.39 | 0.5 |
| Example 9 | 9 | 1.41 | 0.5 | B | 1.39 | 0.5 |
| Example 10 | 10 | 1.42 | 0.6 | B | 1.39 | 0.4 |
| Example 11 | 11 | 1.41 | 0.4 | B | 1.39 | 0.5 |
| Example 12 | 12 | 1.41 | 0.4 | B | 1.39 | 0.4 |
| Example 13 | 13 | 1.40 | 0.4 | B | 1.33 | 0.7 |
| Example 14 | 14 | 1.41 | 0.5 | B | 1.32 | 0.8 |
| Example 15 | 15 | 1.42 | 0.4 | B | 1.31 | 0.8 |
| Example 16 | 16 | 1.41 | 0.5 | B | 1.32 | 0.9 |
| Example 17 | 17 | 1.34 | 0.9 | B | 1.30 | 0.9 |
| Example 18 | 18 | 1.39 | 0.6 | B | 1.31 | 0.8 |
| Example 19 | 19 | 1.28 | 1.5 | B | 1.30 | 0.9 |
| Example 20 | 20 | 1.40 | 0.5 | B | 1.26 | 1.5 |
| Comparative example 1 | Comparative 1 | 1.40 | 0.6 | C | 1.15 | 1.9 |
| Comparative example 2 | Comparative 2 | 1.32 | 1.1 | B | 1.16 | 2.1 |
| Comparative example 3 | Comparative 3 | 1.41 | 0.6 | A | 1.16 | 2.2 |
| Comparative example 4 | Comparative 4 | 1.40 | 0.7 | C | 1.13 | 2.8 |
| Comparative example 5 | Comparative 5 | 1.41 | 0.7 | D | 1.12 | 2.9 |

TABLE 4-2

| | | High-temperature, high-humidity environment | | | |
|---|---|---|---|---|---|
| | Toner No. | Developing performance after 5,000 prints | Post-standing developing performance | Density difference between pre-and-post-standing | Member contamination |
| Example 1 | 1 | 1.39 | 1.35 | 0.04 | A |
| Example 2 | 2 | 1.38 | 1.35 | 0.03 | A |
| Example 3 | 3 | 1.39 | 1.35 | 0.04 | A |
| Example 4 | 4 | 1.34 | 1.30 | 0.04 | A |

TABLE 4-2-continued

| | | High-temperature, high-humidity environment | | | |
|---|---|---|---|---|---|
| | Toner No. | Developing performance after 5,000 prints | Post-standing developing performance | Density difference between pre-and-post-standing | Member contamination |
| Example 5 | 5 | 1.38 | 1.34 | 0.04 | A |
| Example 6 | 6 | 1.34 | 1.29 | 0.05 | A |
| Example 7 | 7 | 1.37 | 1.33 | 0.04 | A |
| Example 8 | 8 | 1.39 | 1.34 | 0.05 | A |
| Example 9 | 9 | 1.39 | 1.35 | 0.04 | A |
| Example 10 | 10 | 1.39 | 1.35 | 0.04 | A |
| Example 11 | 11 | 1.38 | 1.36 | 0.02 | A |
| Example 12 | 12 | 1.39 | 1.36 | 0.03 | A |
| Example 13 | 13 | 1.31 | 1.27 | 0.04 | B |
| Example 14 | 14 | 1.31 | 1.26 | 0.05 | B |
| Example 15 | 15 | 1.31 | 1.22 | 0.09 | B |
| Example 16 | 16 | 1.31 | 1.18 | 0.13 | B |
| Example 17 | 17 | 1.30 | 1.17 | 0.13 | B |
| Example 18 | 18 | 1.31 | 1.16 | 0.15 | B |
| Example 19 | 19 | 1.30 | 1.18 | 0.12 | B |
| Example 20 | 20 | 1.31 | 1.11 | 0.20 | B |
| Comparative example 1 | Comparative 1 | 1.18 | 1.13 | 0.05 | C |
| Comparative example 2 | Comparative 2 | 1.17 | 1.04 | 0.13 | D |
| Comparative example 3 | Comparative 3 | 1.16 | 1.10 | 0.06 | C |
| Comparative example 4 | Comparative 4 | 1.12 | 1.03 | 0.09 | C |
| Comparative example 5 | Comparative 5 | 1.13 | 1.01 | 0.12 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-035805, filed, Feb. 28, 2017, and Japanese Patent Application No. 2018-005701, filed, Jan. 17, 2018, which are hereby incorporated by reference herein in their entirety.

What is claimed is:

1. A toner comprising:

a toner particle; and an external additive containing a strontium titanate particle, the strontium titanate particle having a number-average primary particle diameter of 10 to 60 nm, wherein the toner has an average circularity of 0.935 to 0.995, and the strontium titanate particle has peaks at 39.700°±0.150° and 46.200°±0.150° in a CuKα x-ray diffraction spectrum obtained in the 20 range of 10 to 90° where θ is the Bragg angle, and Sb/Sa is 1.80 to 2.30 where Sa is an area of the peak at 39.700°±0.150° and Sb is an area of the peak at 46.200°±0.150°.

2. The toner according to claim 1, wherein the toner has a glass transition temperature of 50 to 70° C.

3. The toner according to claim 1, wherein Sr/Ti (molar ratio) for the strontium titanate particle is 0.70 to 0.85.

4. The toner according to claim 1, wherein a primary particle of the strontium titanate particle has an average circularity of 0.700 to 0.920.

5. The toner according to claim 1, wherein a methanol concentration at 50% transmittance of light at a wavelength of 780 nm is 60 to 95 volume % in a wettability test of the strontium titanate particle relative to a methanol/water mixed solvent.

6. The toner according to claim 1, wherein the coverage ratio of the surface of the toner by the strontium titanate particle is, as measured 5.0 to 20.0 area % as measured with an x-ray photoelectron spectrometer.

7. The toner according to claim 1, wherein the content of the strontium titanate particle per 100 mass parts of the toner particle is 0.05 to 5.0 mass parts.

8. The toner according to claim 1, wherein the toner particle has a core, and a shell layer present on the surface of the core.

9. The toner according to claim 8, wherein the shell layer contains at least one kind selected from the group consisting of polyester resins, styrene-acrylic copolymers, and styrene-methacrylic copolymers.

10. The toner according to claim 1, which satisfies $3\times10^{-4}\leq E/A\leq50\times10^{-4}$ where A and E are respectively the amounts (atomic %) of carbon atoms and sulfur atoms present on the surface of the toner particle as measured with an x-ray photoelectron spectrometer.

11. The toner according to claim 4, wherein the primary particle of the strontium titanate particle has an average circularity of 0.790 to 0.920.

* * * * *